US007370390B1

(12) United States Patent
Muller

(10) Patent No.: US 7,370,390 B1
(45) Date of Patent: May 13, 2008

(54) PIVOT CONNECTION FOR VACUUM CLEANER NOZZLE

(76) Inventor: Albert F. Muller, 15002 Torry Pines Rd., Houston, TX (US) 77062

( * ) Notice: Subject to any disclaimer, the term of this patent is extended or adjusted under 35 U.S.C. 154(b) by 803 days.

(21) Appl. No.: 10/773,625

(22) Filed: Feb. 5, 2004

Related U.S. Application Data

(60) Provisional application No. 60/444,822, filed on Feb. 5, 2003.

(51) Int. Cl.
*A47L 9/06* (2006.01)

(52) U.S. Cl. ..... 15/415.1

(58) Field of Classification Search ..... None
See application file for complete search history.

(56) References Cited

U.S. PATENT DOCUMENTS 4,091,496 A * 5/1978 Desrosiers et al. ..... 15/371
4,564,972 A * 1/1986 Varin ..... 15/358

FOREIGN PATENT DOCUMENTS

EP 0353546 * 7/1989

* cited by examiner

*Primary Examiner*—David A Redding
(74) *Attorney, Agent, or Firm*—Kenneth A. Roddy

(57) ABSTRACT

A pivot connection for connecting the wand of a vacuum cleaner hose to a vacuum cleaner nozzle of the type having an exhaust aperture through which air is drawn into a vacuum hose. A three-sided curved duct extends upwardly from a top surface of the nozzle, the duct having a transverse generally rectangular cross section with a curved front wall and contiguous laterally opposed side walls. The front wall and side walls have lower portions surrounding the exhaust aperture on three sides, upper ends defining a generally rectangular open end disposed in an angular plane with respect to a vertical axis, and interior surfaces forming an arcuate extension of the exhaust aperture. A hose connector member is pivotally mounted on the nozzle and has an elongate tubular portion with a generally rectangular flange at a lower end sized and shaped to engage the interior surfaces of the duct in a sliding air-sealing relation, and a central longitudinal bore dimensioned to receive and frictionally engage a tubular wand attached to one end of a vacuum hose. The hose connector is pivotal in a vertical plane about a horizontal axis between a lowermost position and an uppermost position relative to the nozzle and the duct.

9 Claims, 4 Drawing Sheets

PIVOT CONNECTION FOR VACUUM CLEANER NOZZLE

CROSS REFERENCE TO RELATED APPLICATION

This application claims priority of U.S. Provisional Application Ser. No. 60/444,822, filed Feb. 5, 2003.

BACKGROUND OF THE INVENTION

1. Field of the Invention

This invention relates generally to vacuum cleaner nozzles, and more particularly to a pivot connection for connecting a vacuum cleaner hose to a vacuum cleaner nozzle, and a nozzle having such a pivot connection.

2. Brief Description of the Prior Art

Nozzles with pivoted wands are known in the art. These take many forms but include, essentially, a means for pivoting the wand to the nozzle so that relative rotational displacement in a vertical plane may take place between the two to permit the operator of the nozzle to push it over the floor or carpet that is being cleaned. However, none of these arrangements provide the combination of features working together as a whole as set forth in the present invention.

Matchette, U.S. Pat. No. 1,020,104 discloses a vacuum sweeper having a tube with a longitudinal slot in the under side, and a port in the upper middle portion, a shoe having bearings on opposite sides of, and approximately parallel with, the tube, and connected at the ends by arches in which the tube is fitted and secured. A tubular shank having a transverse con-cave bearing is fitted to turn upon the tube and guided at the ends in the arches, and a passage in the shank is in communication with the port in the tube.

Wolf, U.S. Pat. No. 3,550,183 discloses a cleaning tool comprising a housing adapted for connection to an operating handle or wand. The housing has a generally flat surface-engaging portion and an elongated crowned portion extending upwardly from the surface-engaging portion defining a suction chamber with an outlet in the crowned portion. A brush is centrally mounted in the suction chamber and extends downwardly for engagement with the surface to be cleaned. A plurality of orifices spaced along the lengthwise extent of the crowned portion extend from the exterior of the housing downwardly into the chamber, so as to direct jet inlet air flow diagonally downwardly to impinge against the surface being cleaned for effective jet air scrubbing of the surface and "boiling" of debris upwardly from the surface. The underside of the housing is provided with passageways extending from communication with the suction chamber to the periphery of the tool housing for cleaning out corners or other hard-to-clean areas. The outlet from the suction chamber is defined by a tubular portion extending rearwardly from the crown portion of the housing, and which is disposed very close to the surface being cleaned to materially increase the debris "pick up" ability of the tool.

Candor, U.S. Pat. No. 3,780,398 discloses in combination with a nozzle construction for a vacuum cleaning operation, a separate member having a body portion detachably secured to the nozzle construction and having a flexible wall surrounding the inlet of the nozzle construction and outboard of the same to have one side thereof engage against a surface means around the inlet to substantially seal the inlet of the nozzle construction to the surface means. The flexible wall is so constructed and arranged that a pressure differential acting across the same and resulting from a vacuum pump drawing fluid from the surface means into the inlet of the nozzle construction is adapted to cause the flexible wall to be urged toward the surface means to substantially seal against the same around the inlet and substantially conform to the contour of the surface means outboard of the nozzle construction.

Desrosiers et al, U.S. Pat. No. 4,091,496 discloses a vacuum cleaner nozzle particularly adapted to clean carpets and characterized by its efficient combination of central brushing and downward and inward air flows on opposite sides and toward the central brush and also characterized by selective height setting in relation to the length of the hairs of a carpet. This vacuum cleaner nozzle includes a central body defining an air suction chamber, a rim engaging around the central body and cooperatively forming therewith a pair of downwardly extending slots laterally communicating with the central suction chamber under the nozzle, these slots extending against the laterally opposite sides of the central body, and the rim being settable relative to the latter in relation to the length of the hairs of any carpet.

Fleischhauer, U.S. Pat. No. 4,638,527 discloses vacuum cleaner attachments which have a V-shaped cleaning head and are particularly suited for cleaning in corners and crevices and along the edges of surfaces. Vertically biased and rotatable brushes and other disturbers can be provided to promote the dislodgement of foreign substances from the surface being cleaned. A preferred universal-type connection between the cleaning head and a vacuum fitting attached thereto facilitate the manipulation of the attachment and allow pressure to be brought to bear on the nose of the cleaning head, thereby promoting the dislodgement of foreign substances from the surface being cleaned.

The present invention is distinguished over the prior art in general, and these patents in particular by a pivot connection for connecting the wand of a vacuum cleaner hose to a vacuum cleaner nozzle of the type having an exhaust aperture through which air is drawn into a vacuum hose. A three-sided curved duct extends upwardly from a top surface of the nozzle, the duct having a transverse generally rectangular cross section with a curved front wall and contiguous laterally opposed side walls. The front wall and side walls have lower portions surrounding the exhaust aperture on three sides, upper ends defining a generally rectangular open end disposed in an angular plane with respect to a vertical axis, and interior surfaces forming an arcuate extension of the exhaust aperture. A hose connector member is pivotally mounted on the nozzle and has an elongate tubular portion with a generally rectangular flange at a lower end sized and shaped to engage the interior surfaces of the duct in a sliding air-sealing relation, and a central longitudinal bore dimensioned to receive and frictionally engage a tubular wand attached to one end of a vacuum hose. The hose connector is pivotal in a vertical plane about a horizontal axis between a lowermost position and an uppermost position relative to the nozzle and the duct.

Another aspect of the present invention is the pivot connection in combination with a nozzle of generally square or rectangular configuration having a slightly concave or flat main body portion with a central exhaust aperture through which air is drawn into a vacuum hose. The main body portion has a top surface, a bottom surface, and opposed straight sides. A series of spacer protrusions formed in the surface of the main body extend downwardly from the bottom surface and along a horizontal plane to serve as legs to space the concave bottom surface a predetermined distance above the surface to be cleaned. The nozzle is configured to draw air between the surface to be cleaned and the bottom surface of the nozzle at a substantially uniform velocity which is proportional to the inflow velocity of the vacuum hose, and to maintain little or no difference in static pressure between the air under the nozzle and the static pressure of the air above the nozzle.

SUMMARY OF THE INVENTION

It is therefore an object of the present invention to provide a pivot connection for connecting the wand of a vacuum cleaner hose to a vacuum cleaner nozzle that is simple in construction and has only one moving part.

It is another object of this invention to provide a pivot connection having an arcuate duct affixed to a vacuum cleaner nozzle with a hose connector member pivotally mounted on the nozzle with a lower end engaged with the interior surfaces of the duct in a sliding air-sealing relation.

Another object of this invention is to provide a pivot connection having an arcuate duct affixed to a vacuum cleaner nozzle with a hose connector member pivotally mounted on the nozzle with a lower end engaged with the interior surfaces of the duct in a sliding air-sealing relation wherein the hose connector is pivotal in a vertical plane about a horizontal axis between a lowermost position and an uppermost position relative to the nozzle and the duct.

Another object of this invention is to provide a nozzle configured to draw air between the surface to be cleaned and the bottom surface of the nozzle at a substantially uniform velocity which is proportional to the inflow velocity of the vacuum hose, and to maintain little or no difference in static pressure between the air under the nozzle and the static pressure of the air above the nozzle.

A further object of this invention is to provide an arcuate duct affixed to a vacuum cleaner nozzle and a hose connector member pivotally mounted on the nozzle wherein the nozzle configured to draw air between the surface to be cleaned and the bottom surface of the nozzle at a substantially uniform velocity which is proportional to the inflow velocity of the vacuum hose, and to maintain little or no difference in static pressure between the air under the nozzle and the static pressure of the air above the nozzle Other objects of the invention will become apparent from time to time throughout the specification and claims as hereinafter related.

The above noted objects and other objects of the invention are accomplished by a pivot connection for connecting the wand of a vacuum cleaner hose to a vacuum cleaner nozzle of the type having an exhaust aperture through which air is drawn into a vacuum hose. A three-sided curved duct extends upwardly from a top surface of the nozzle, the duct having a transverse generally rectangular cross section with a curved front wall and contiguous laterally opposed side walls. The front wall and side walls have lower portions surrounding the exhaust aperture on three sides, upper ends defining a generally rectangular open end disposed in an angular plane with respect to a vertical axis, and interior surfaces forming an arcuate extension of the exhaust aperture. A hose connector member is pivotally mounted on the nozzle and has an elongate tubular portion with a generally rectangular flange at a lower end sized and shaped to engage the interior surfaces of the duct in a sliding air-sealing relation, and a central longitudinal bore dimensioned to receive and frictionally engage a tubular wand attached to one end of a vacuum hose. The hose connector is pivotal in a vertical plane about a horizontal axis between a lowermost position and an uppermost position relative to the nozzle and the duct.

Another aspect of the present invention is the pivot connection in combination with a nozzle of generally square or rectangular configuration having a slightly concave or flat main body portion with a central exhaust aperture through which air is drawn into a vacuum hose. The main body portion has a top surface, a bottom surface, and opposed straight sides. A series of spacer protrusions formed in the surface of the main body extend downwardly from the bottom surface and along a horizontal plane to serve as legs to space the concave bottom surface a predetermined distance above the surface to be cleaned. The nozzle is configured to draw air between the surface to be cleaned and the bottom surface of the nozzle at a substantially uniform velocity which is proportional to the inflow velocity of the vacuum hose, and to maintain little or no difference in static pressure between the air under the nozzle and the static pressure of the air above the nozzle.

DESCRIPTION OF THE PREFERRED EMBODIMENTS

Figure 1:
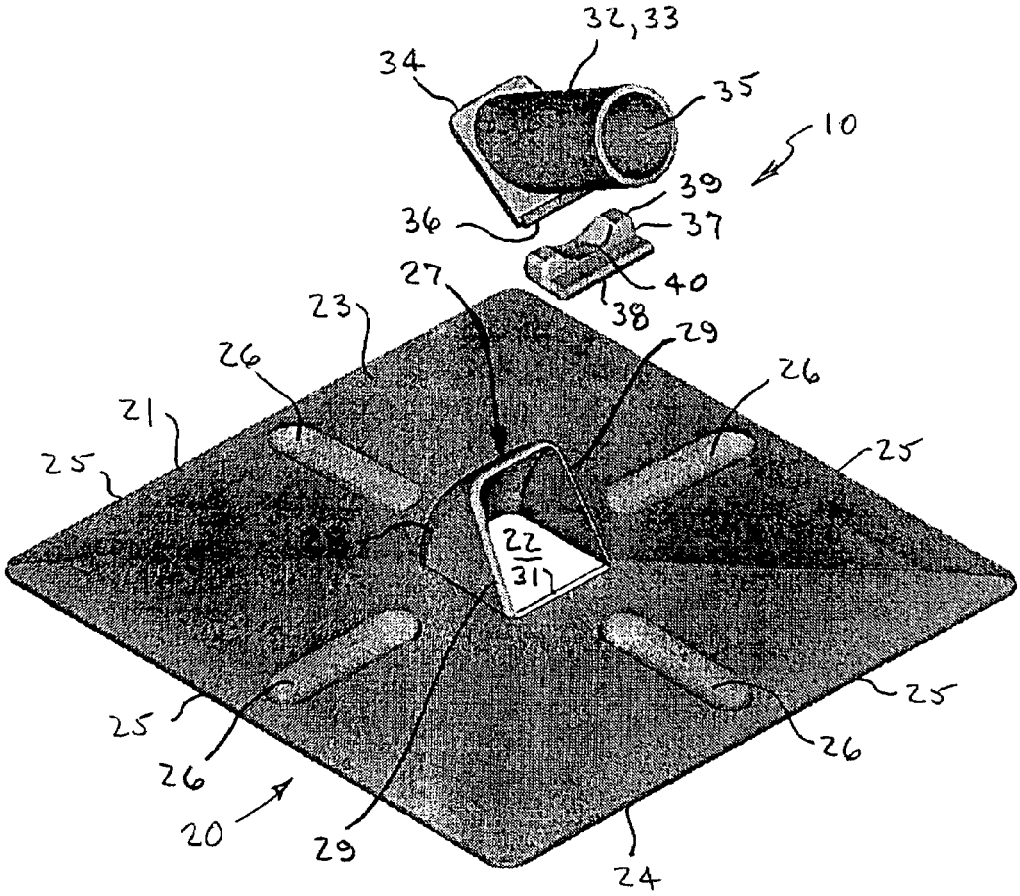
FIG. 1 is an exploded isometric view of the components of the pivot connection in accordance with a preferred embodiment of the present invention.

In the following discussion, the nozzle shown in the drawings, for purposes of illustrating an example, is a generally rectangular vacuum cleaner nozzle of the type shown and described in detail in my previous patent U.S. Pat. No. 6,105,207, which is hereby incorporated herein in its entirety by reference. However, it should be clearly understood that the pivot connection in accordance with the present invention may be provided on substantially any type of nozzle having an exhaust aperture through which air is drawn into a vacuum hose connected with the nozzle.

Figure 2:
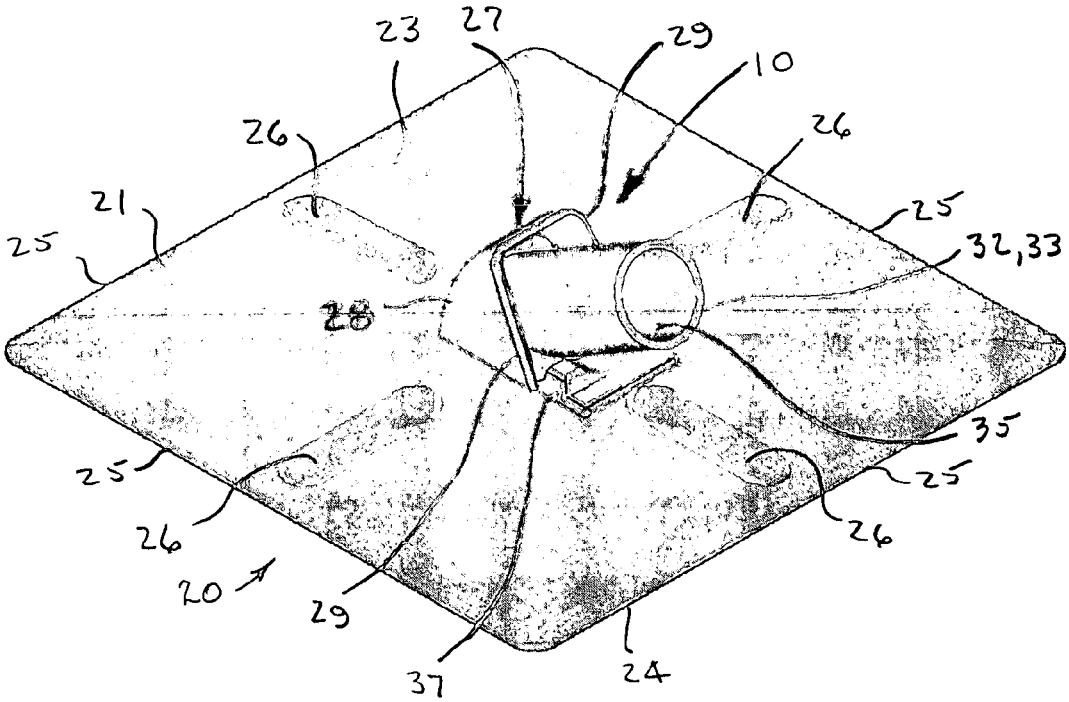
FIG. 2 is an isometric view of the pivot connection in an assembled condition on a nozzle.
Figure 3:
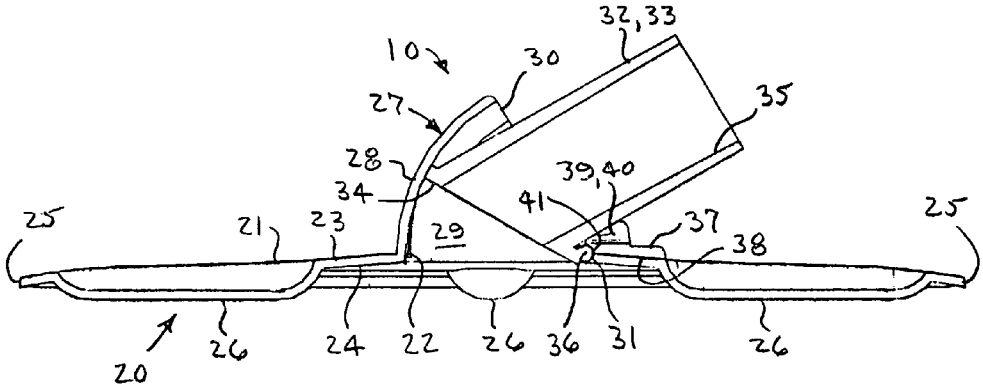
FIG. 3 is a cross sectional view through the pivot connection in an assembled condition.
Figure 4:
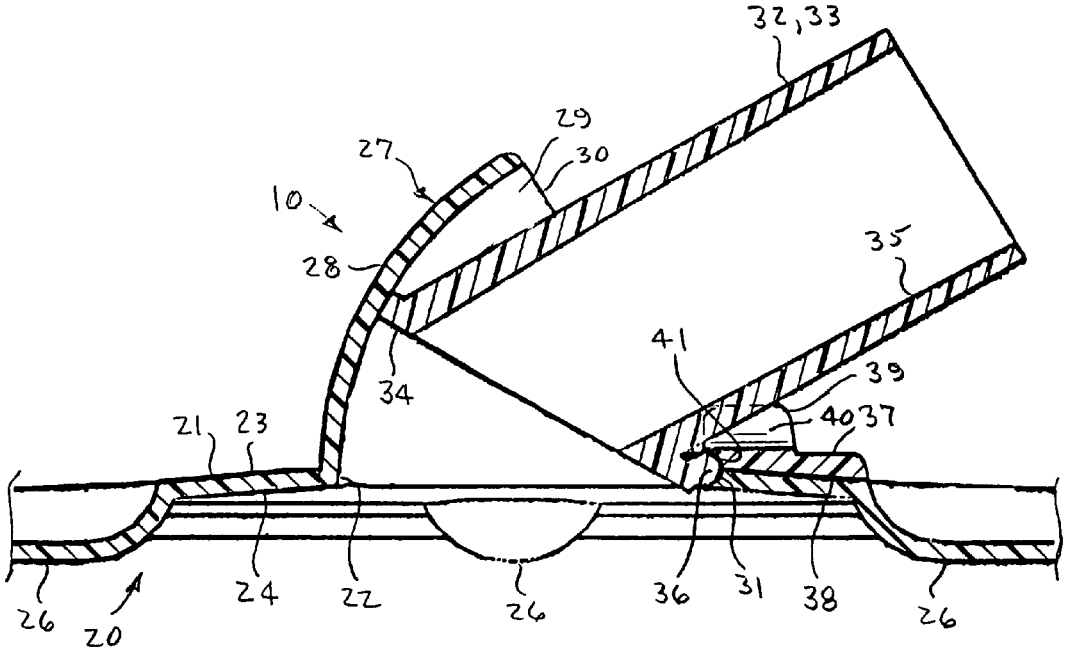
FIG. 4 is an enlarged cross sectional view showing the pivot connection in greater detail with the hose connector in an intermediate position.

Referring now to the drawings by numerals of reference, there is shown in FIG. 1, an exploded isometric view of the components of a pivot connection 10 and nozzle 20, in accordance with a preferred embodiment in an unassembled condition. FIG. 2 shows the pivot connection 10 in an assembled condition on the vacuum cleaner nozzle 20. FIG. 3 is a cross sectional view through the pivot connection 10 in the assembled condition, and FIG. 4 shows the assembled pivot connection 10 in greater detail.

In the illustrated example, the nozzle 20 is a generally square or rectangular configuration having a slightly concave or flat main body portion 21 with a central exhaust aperture 22 through which air is drawn into a vacuum hose. The main body portion 21 has a top surface 23, a bottom surface 24, and opposed straight sides 25. A series of elongate concave spacer protrusions 26 are formed in the surface of the main body portion 21 in radially spaced relation. As best seen in cross section in FIG. 3, the concave spacer protrusions 26 extend downwardly from the bottom surface 24 of the main body portion 21 and along a horizontal plane to serve as legs to space the concave bottom surface of the main body portion a predetermined distance above the surface to be cleaned. The particular nozzle depicted is configured to draw air between the surface to be cleaned and the bottom surface of the nozzle at a substantially uniform velocity which is proportional to the inflow velocity of the vacuum hose, and to maintain little or no difference in static pressure between the air under the nozzle and the static pressure of the air above the nozzle as described in detail in my previous patent U.S. Pat. No. 6,105,207.

A three-sided curved duct 27 extends upwardly from the top surface 23 of the nozzle body 21. The curved duct 27 is generally rectangular in transverse cross section and has a curved front wall 28, and contiguous laterally opposed side walls 29. The bottom ends of the front wall 28 and lateral side walls 29 surround the exhaust aperture 22 on three sides. The top ends of the front wall 28 and lateral side walls 29 define a generally rectangular open end 30. The open end 30 of the duct 27 is disposed in an angular plane at an angle of approximately 30° with respect to a vertical axis. The interior surfaces of the duct 27 form an arcuate extension of the exhaust aperture 22. The nozzle body surface at the bottom of the open end 30 is provided with an arcuate recess 31 that extends transversely between the bottom ends of the lateral side walls 29 of the duct 27.

A hose connector member 32 is pivotally mounted on the main body 21 of the nozzle 20. The hose connector 32 has an elongate tubular portion 33 and a generally rectangular flange 34 at lower end. The generally rectangular flange 34 extends outward a short distance from the tubular portion 33 and is disposed in an angular plane at an angle of approximately 60° with respect to the longitudinal axis of the tubular portion. A central bore 35 extends through the hose connector 32 and is tapered slightly inward along its length toward the flanged end. The tapered bore 35 is dimensioned to receive and frictionally engage a conventional rigid tubular wand attached to one end of a vacuum hose (not shown). A rod-like protrusion 36 extends transversely along the back edge of one side of the flange 34, and is dimensioned to be rotatably received in the arcuate recess 31 that extends transversely between the bottom ends of the lateral side walls 29 of the duct 27. The outer periphery of the flange 34 is sized and shaped to engage the interior surfaces of the duct 27 in a sliding air-sealing relation and the tapered bore 35 is in fluid communication with the interior of the duct and the exhaust aperture 22.

The hose connector member 32 is pivotally secured to the main body 21 of the nozzle 20 by a backstop plate 37 that is secured adjacent to the rectangular open end 30 of the duct 27. The backstop plate 37 is a generally rectangular member having a generally flat bottom surface 38 and a raised portion 39 extending along its top side that is provided with a central curved recess 40 which forms a stop surface for the tubular portion 33 of the hose connector 32 in a lowermost pivoted position. The bottom surface 38 of the backstop plate 39 is provided with an arcuate recess 41 that extends transversely along the longitudinal edge beneath the raised portion 39. The arcuate recess 41 is the same size as the arcuate recess 31 in the nozzle body that extends transversely between the lateral side walls 29 of the duct 27.

The pivot connection 10 is assembled by inserting the flanged end 34 of the hose connector 32 into the duct 27 with its rod-like protrusion 36 received in the arcuate recess 31 of the nozzle body that extends transversely between the bottom ends of the lateral side walls 29 of the duct 27. The backstop plate 37 is then placed onto the top surface 23 of the nozzle body 21 with the arcuate recess 41 in its bottom surface 38 received on the upper portion of the rod-like protrusion 36 of the hose connector 32, and is then secured to the nozzle body 21.

In the assembled condition, the curved recess 31 of the nozzle body 21 and curved recess 41 of the backstop plate 37 encircle the outer half of the rod-like protrusion 36 on the flange 34 of the hose connector 32, and the outer periphery of the flange 34 is engaged with the interior surfaces of the duct 37 in a sliding air-sealing relation with its tapered bore 35 in fluid communication with the interior of the duct and exhaust aperture 22.

The backstop plate 37 may be secured to the nozzle body 21 by various means conventional in the art. For example, the nozzle body 21 may be provided with a narrow slot a short distance outwardly from the from the open end 30 of the duct 27 and the backstop plate 37 provided with a depending narrow protrusion or tongue extending along its bottom surface which is engaged in the transverse slot of the nozzle body in a snap fit relation. The backstop plate 37 may also be secured to the nozzle body 21 by screws installed through holes in the backstop plate and threadedly engaged in holes in the nozzle body. The backstop plate 37 may also be secured to the nozzle body 21 by snap fittings, gluing, sonic welding, etc.

Figure 5:
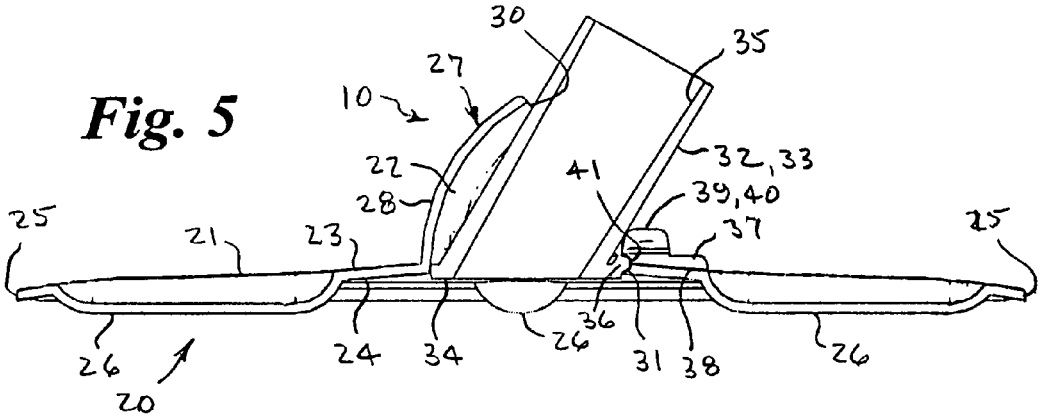
FIG. 5 is a cross sectional view through the pivot connection, showing the hose connector member in an uppermost position.
Figure 6:
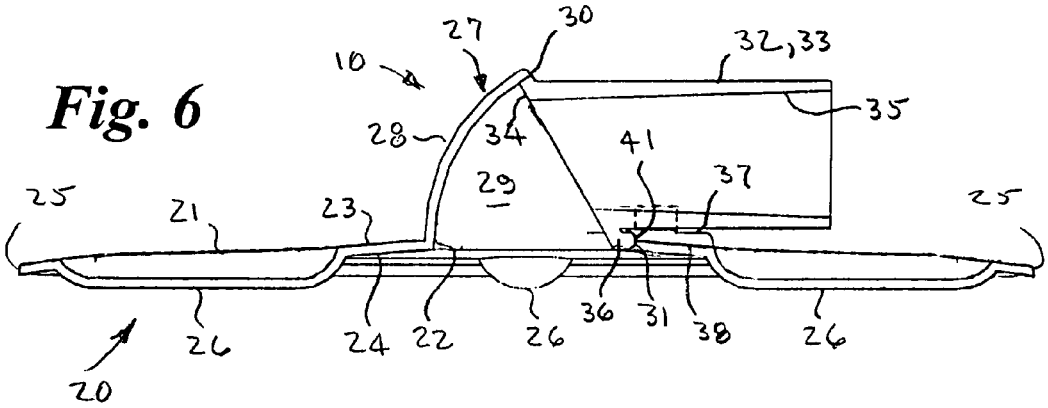
FIG. 6 is a cross sectional view through the pivot connection, showing the hose connector member in a lowermost position.

The hose connector 32 can pivot in a vertical plane relative to the nozzle body 21 about the horizontal axis of the transverse rod-like protrusion 36 between an uppermost position, as shown in FIG. 5, and a lowermost position as shown in FIG. 6. In the uppermost position, the top edge of the curved wall 28 of the duct 27 serves as an upper stop surface for the hose connector 32, and the outer periphery of the flange 34 remains within the interior of the duct due to its angular disposition. In the lowermost position, the curved recess 40 of the backstop plate 37 serves as a lower stop surface for the hose connector 32, and the outer periphery of the flange 34 remains within the interior of the duct 27 due to its angular disposition.

Figure 7:
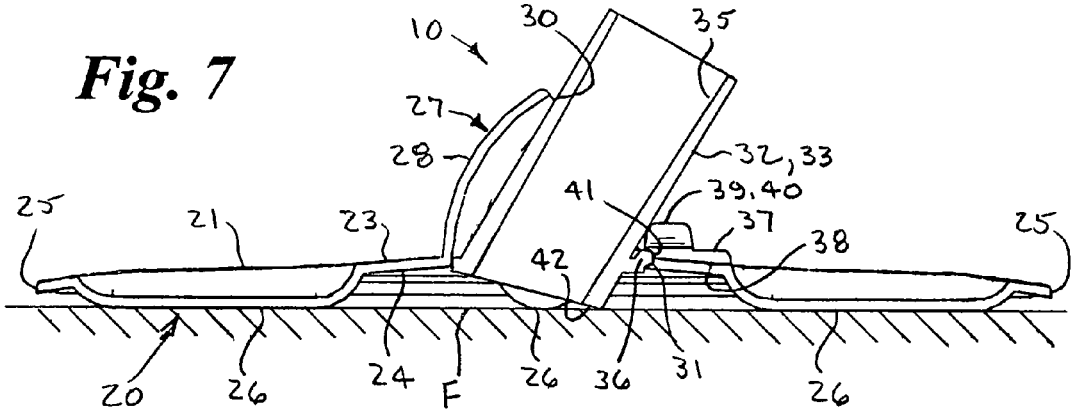
FIG. 7 is a cross sectional view through the pivot connection, showing a modification of the hose connector member having an extended bottom portion that serves as a scraper when the hose connector member is in an uppermost position.

FIG. 7 shows a modification of the hose connector member 32 having an extended angular bottom end 42. One side of the hose connector member 32 extends downwardly a distance below the side of the flange 34 having the rod-like protrusion 36 and its bottom end extends angularly upward to the opposed side of the flange. When the hose connector 32 is in its uppermost pivoted position the lower end of the angled bottom 42 will engage the surface of the floor F and can be used as a scraper for dislodging debris and substances that may be adhered to the floor surface. This modification also places the bottom end of the hose connector slightly closer the floor surface during normal operation, and allows heavier items to be sucked up.

It should be understood that the hose connector member 10 may be pivotally secured to the nozzle body 21 by other means. For example, the rod-like protrusion 36 on the flange 34 of the hose connector 32 may be extended laterally outward and snap fitted into recesses in the nozzle body, or snap fitted into a pair of laterally spaced raised ears on the nozzle body. The rod-like protrusion 26 on the flange 34 of the hose connector 32 may also be made larger in diameter and provided with a bore and pivotally pinned between a pair of laterally spaced raised ears on the nozzle body by a pivot pin.

While this invention has been described fully and completely with special emphasis upon preferred embodiments, it should be understood that within the scope of the appended claims the invention may be practiced otherwise than as specifically described herein.

I claim:

1. A pivot connection for connecting the wand of a vacuum cleaner hose to a vacuum cleaner nozzle of the type having an exhaust aperture through which air is drawn into a vacuum hose, the pivot connection comprising in combination:

a hollow three-sided arcuate duct having a transverse generally rectangular cross section with a curved front wall and contiguous laterally opposed side walls having lower ends adjoined to a top surface of the nozzle surrounding the exhaust aperture on three sides forming an arcuate extension with an interior in air flow communication with the exhaust aperture and terminating in a generally rectangular open top end disposed in an angular plane with respect to a vertical axis; and a hollow tubular hose connector member having an elongate tubular portion with a lower end pivotally mounted in said duct and a central longitudinal bore adapted to receive and engage a tubular wand attached to one end of a vacuum hose, said hose connector lower end configured to engage said duct interior in a sliding air-sealing relation; wherein said hose connector is pivotal in a vertical plane about a horizontal axis between a lowermost position and an uppermost position relative to the nozzle and said duct.

2. The pivot connection according to claim 1, wherein said generally rectangular open end of said duct arcuate extension is disposed in an angular plane at an angle of about 30° with respect to a vertical axis.

3. The pivot connection according to claim 1, wherein said hose connector member has a generally rectangular flange at said lower end sized and shaped to engage said interior of said duct arcuate extension in a sliding air-sealing relation.

4. The pivot connection according to claim 1, wherein said hose connector member a central longitudinal bore tapered is slightly inward along its length toward said lower end dimensioned to receive and frictionally engage the tubular wand attached to one end of the vacuum hose.

5. The pivot connection according to claim 3, further comprising:

a backstop member disposed adjacent to said rectangular open end of said duct arcuate extension, and having a stop surface configured to engage said tubular portion of said hose connector in its said lowermost pivoted position whereby said generally rectangular flange remains within said duct interior of said arcuate extension.

6. The pivot connection according to claim 1, wherein said generally rectangular open end of said duct arcuate extension is disposed in an angular plane at an angle of about 30° with respect to a vertical axis; and said hose connector member has a generally rectangular flange at said lower end extending outward a short distance from said tubular portion disposed in an angular plane at an angle of approximately 60° with respect to a longitudinal axis of said tubular portion.

7. The pivot connection according to claim 3, further comprising:

a recess extending transversely between a lower end of said duct laterally opposed side walls; and a rod-like protrusion extending transversely along a back edge of one side of said generally rectangular flange rotatably received in said recess.

8. The pivot connection according to claim 1, wherein said hose connector member has a generally rectangular flange at said lower end engaged in said interior of said duct arcuate extension in a sliding air-sealing relation, one side of said flange pivotally mounted at a lower end of said duct; and said hose connector member has an angular bottom end extending downwardly a distance below said generally rectangular flange sized and shape to engage a floor surface when said hose connector member is in its said uppermost pivoted position to be used as a scraper for dislodging debris and substances that may be adhered to the floor surface.

9. A vacuum cleaner nozzle for attachment to a wand at one end of a vacuum hose, comprising:

a nozzle having a main body portion including a top surface, a bottom surface and an outer periphery, a central exhaust aperture in said top surface through which air is drawn into the vacuum hose, and spacer means on said bottom surface adapted to be supported on a surface to be cleaned and sized to position said bottom surface a predetermined height above the surface to be cleaned;

a hollow three-sided arcuate duct having a transverse generally rectangular cross section with a curved front wall and contiguous laterally opposed side walls having lower ends adjoining said main body top surface surrounding said exhaust aperture on three sides forming an arcuate extension with an interior in air flow communication with said exhaust aperture, and terminating in a generally rectangular open top end disposed in an angular plane with respect to a vertical axis;

a hollow tubular hose connector member having a lower end pivotally mounted in said duct and a central longitudinal bore adapted to receive and engage a tubular wand attached to one end of the vacuum hose, said hose connector lower end having a generally rectangular configuration engaged in said duct interior in a sliding air-sealing relation; wherein said hose connector is pivotal in a vertical plane about a horizontal axis between a lowermost position and an uppermost position relative to said main body portion and said duct, and said main body portion is disposed at a height above the surface to be cleaned to draw air between said surface to be cleaned and said bottom surface at a substantially uniform velocity proportional to the inflow velocity of air into the vacuum hose, and the static pressure of the air drawn between said surface to be cleaned and said bottom surface is approximately equal to the static pressure of the air above said main body portion.

* * * * *